US006131408A

United States Patent [19]

Gill

[11] Patent Number: 6,131,408

[45] Date of Patent: Oct. 17, 2000

[54] JEWEL WITH INTERCHANGEABLE ENHANCERS

[76] Inventor: Laurie Gill, 9575 Starlight La., La Mesa, Calif. 91941

[21] Appl. No.: 08/968,127

[22] Filed: Nov. 12, 1997

[51] Int. Cl.[7] ..... A44C 19/00

[52] U.S. Cl. ..... 63/15.8; 63/1.16; 63/15; 63/29.1; 63/40

[58] Field of Search ..... 63/1.16, 15, 15.1, 63/15.2, 15.3, 15.4, 15.6, 15.7, 15.8, 29.1, 40

[56] References Cited

U.S. PATENT DOCUMENTS

| | | | |
|---|---|---|---|
| D. 254,537 | 3/1980 | Abelson | D11/34 |
| 901,333 | 10/1908 | Fitzgerald | 63/29.1 |
| 984,058 | 2/1911 | Zimmermann | 63/1.16 |
| 1,045,106 | 11/1912 | Mayer | 63/29.1 X |
| 2,105,227 | 1/1938 | Richter | 63/15 |
| 2,119,039 | 5/1938 | Boyd | 63/15 |
| 2,316,225 | 4/1943 | De De Hoffmann et al. | 63/15 X |
| 2,493,285 | 1/1950 | Granat | 63/15.2 |
| 3,180,112 | 4/1965 | Lefkowitz | 63/29.1 |
| 3,619,913 | 11/1971 | Albrecht | 63/15.7 X |
| 3,805,549 | 4/1974 | Nielsen | 63/15 X |
| 3,949,569 | 4/1976 | Gutschneider | 63/15 |
| 4,080,803 | 3/1978 | Suzuki | 63/15.4 |
| 4,165,574 | 8/1979 | Sciotti | 63/29.1 X |
| 4,195,493 | 4/1980 | Bogner et al. | 63/15 |
| 4,220,017 | 9/1980 | Freeman | 63/15 |
| 4,309,879 | 1/1982 | Gretz et al. | 63/29 R |
| 4,753,087 | 6/1988 | D'Annunzio | 63/15.45 |
| 4,794,766 | 1/1989 | Schunk et al. | 63/15 |
| 5,027,617 | 7/1991 | Bonchek | 63/15.3 |
| 5,076,073 | 12/1991 | Boucheron | 63/29.1 |
| 5,193,360 | 3/1993 | Lovegrove | 63/15 |
| 5,228,317 | 7/1993 | Hendricks | 63/15.7 |
| 5,253,490 | 10/1993 | Doganay | 63/15.4 |
| 5,253,491 | 10/1993 | Buontempo et al. | 63/15.6 |
| 5,417,085 | 5/1995 | Regev | 63/15.2 |
| 5,419,158 | 5/1995 | Sandberg et al. | 63/15.4 |
| 5,735,144 | 4/1998 | Gabel | 96/15.3 X |

FOREIGN PATENT DOCUMENTS

| | | | |
|---|---|---|---|
| 2242050 | 3/1975 | France | 63/15.4 |
| 414229 | 12/1966 | Switzerland | 63/15.4 |

*Primary Examiner*—Terry Lee Melius
*Assistant Examiner*—Andrea Chop
*Attorney, Agent, or Firm*—Calif Tervo

[57] ABSTRACT

A jewel, such as an earring or other pendant, a broach or a finger ring, may be worn alone or with one of a plurality of readily attachable and interchangeable enhancers. In a preferred embodiment, a finger ring generally comprises a band for encircling the finger and a plurality of attachable enhancers. The band appears to be a conventional ring having any desirable setting and a concave inner side for disposition toward the finger. However, a blind bore in the inner side includes a resilient collar. Each enhancer includes a base having a concave inner side for disposition toward the finger and a convex outer side for mating with the inner side of the band at the bore. A stem attached to the outer side of the base has a bulbous distal portion. Upon attachment of enhancer to band, the stem is inserted in the bore and through the collar which deforms and retains the stem. Front and back ornamental portions, attached to the base, are visible in front and back of the band.

24 Claims, 1 Drawing Sheet

FIG. 2
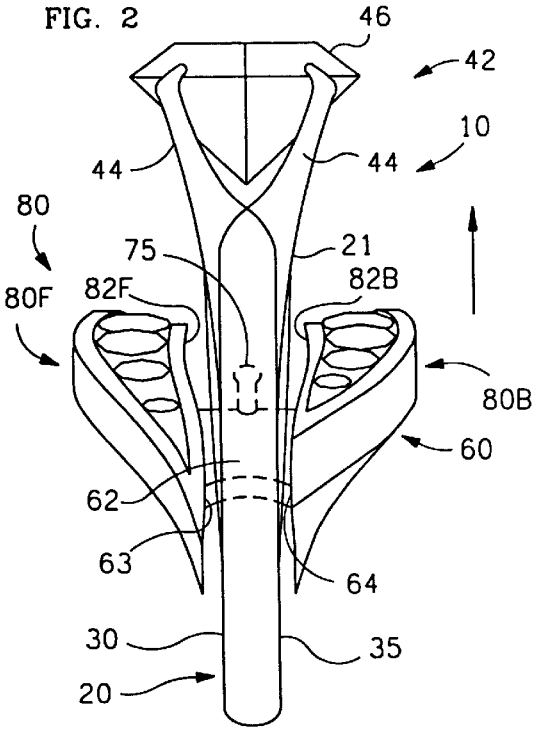
FIG. 1
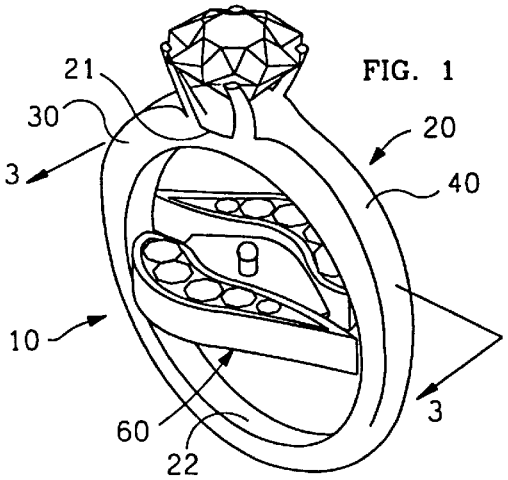
FIG. 3
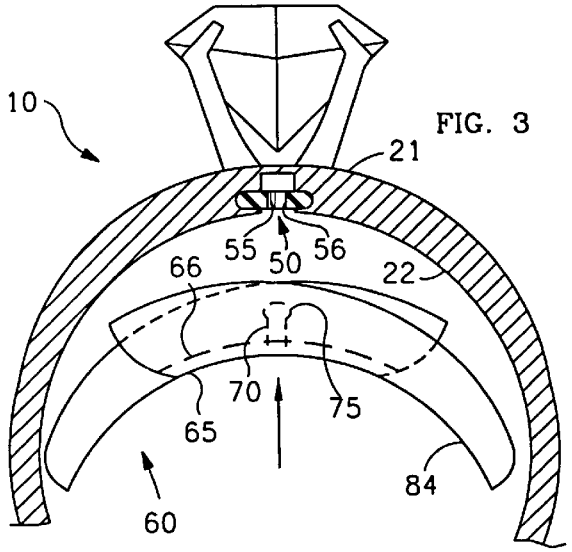
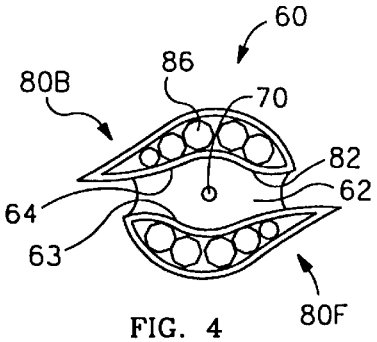
FIG. 4
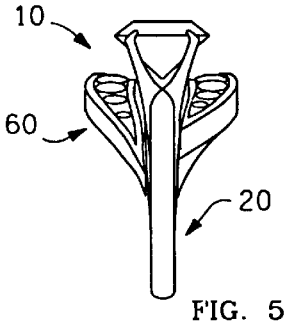
FIG. 5
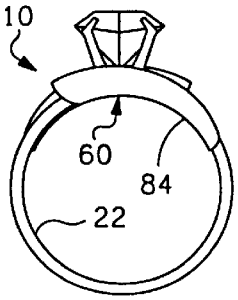
FIG. 6
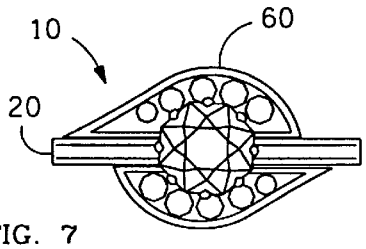
FIG. 7
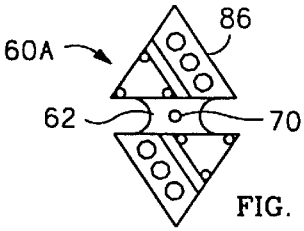
FIG. 8
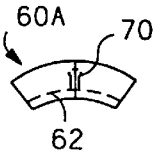
FIG. 9

JEWEL WITH INTERCHANGEABLE ENHANCERS

FIELD OF THE INVENTION

This invention relates in general to a jewelry and more specifically to a jewel, such as a broach, an earring or other pendant or a ring, which may be worn alone or with one of a plurality of readily attachable and interchangeable enhancers.

DESCRIPTION OF THE PRIOR ART

The desirability of a jewel, such as a broach, an earring or other pendant or a ring, with readily changeable ornamental parts has long been evident in the art. A jewel of this type permits a wearer to match jewelry with other articles of jewelry, clothing or accessories. Prior art devices have not been accepted in the industry for various reasons. Notably, most are relatively complicated and costly to manufacture. Some require use of a tool, such as a screw driver, which detracts from their utility. Some do not sufficiently retain the changeable enhancer such that the enhancer may move or rattle or may even be easily dislodged and lost. In others, the enhancer does not attach such that the enhancer appears to be an integral part of the jewel.

Therefore, there has been a need for a jewel with interchangeable enhancers that overcomes the shortcomings of the prior art; a jewel simple in manufacture and low in cost that is readily adaptable to a multiplicity of enhancers of various sizes and shapes, that sufficiently retains an attached enhancer and yet provides ease of enhancer exchange without tools.

SUMMARY OF THE INVENTION

This invention is a jewel, such as a broach or an earring or pendant or a ring with an enhancer. The preferred embodiment is a finger ring and it generally comprises a band for encircling the finger and a plurality of attachable enhancers.

In a preferred embodiment, the band appears to be a conventional ring having any desirable setting and a concave inner side for disposition toward the finger. However, a blind bore in the inner side includes a resilient O-ring.

Each enhancer includes a base including a front side, a back side, a concave inner side for disposition toward the finger and a convex outer side for mating with the inner side of the band at the bore. A stem attached to the outer side of the base has a bulbous distal portion. Upon attachment of enhancer to band, the stem is inserted in the bore and the bulb elastically deforms the O-ring upon passage therethrough such that the O-ring retains the stem and, therefore, the enhancer, to the band.

A front ornamental portion is attached to the front side of said base and is visible in outer side view in front of the front side of the band and a back ornamental portion attached to the back side of the base is visible in outer side view in back of the back side of the band. Preferably, each ornamental portion has a band-facing side that conforms to its side of the band so as to fit snugly against the band so as to not rattle and so as to appear to be an integral part of the ring.

Other features and many attendant advantages of the invention will become more apparent upon a reading of the following detailed description together with the drawings in which like reference numerals refer to like parts throughout.

BRIEF DESCRIPTION OF THE DRAWING

FIG. 1 is a perspective view of a preferred embodiment of the ring with interchangeable enhancer of the invention showing the enhancer in position for attachment.

FIG. 2 is an enlarged right side elevation view of FIG. 1.

FIG. 3 is an enlarged front view of FIG. 1 showing the ring partially cut away and in partial cross-section on line 3—3 of FIG. 1.

FIG. 4 is a top plan view of the enhancer of FIG. 1.

FIG. 5 is an right side elevation view of ring and enhancer of FIG. 1 with the enhancer in attached position.

FIG. 6 is a front elevation view of FIG. 5.

FIG. 7 is a top plan view of FIG. 5.

FIG. 8 is a top plan view of an alternate enhancer.

FIG. 9 is a front elevation view of the alternate enhancer of FIG. 8.

DETAILED DESCRIPTION OF THE INVENTION

With reference now to the drawings, FIGS. 1–7 are views of a preferred embodiment of the finger ring 10 of the invention. Ring 10 generally comprises a band 20 for encircling a finger and an enhancer 60 which is selectably attachable and detachable.

Band 20 includes an inner side 22 that is concave for disposition toward the finger, a front side 30, a back side 35 and a display side, such as outer side 40. The top of band 20 broadens into a collet 21 for a solitaire setting 42. Prongs 44, supported by collet 21 support and display stone 46. As thus far described, band 20 appears to be a common solitaire.

As best seen in cross-section in FIG. 3, a bore 50 is located in the inner side 22 of band 20. In the preferred embodiment, bore 50 is blind and is located in collet 21 at the top of band 20 below stone 46. A catch, preferably in the form of a resilient collar, such as rubber O-ring 55, is set in a counter-bore or channel within bore 50. O-ring 55 has a central aperture 56.

As best seen in FIGS. 2–4, enhancer 60 generally comprises a base 62, a stem 70 and ornamental portions 80 including front ornamental portion 80F and back ornamental portion 80B.

Base 62 includes a front side 63, a back side 64, an inner side 65 and a mating side, such as outer side 66. Inner side 65 is concave for disposition toward the finger for fitting the curve of the finger. As best seen in FIG. 3, outer side 66 is convex and, as best seen in FIG. 4, is shaped to conform to and cover inner side 22 of band 20 at bore 50.

Stem 70 is attached to outer side 66 of base 60. Stem 70 is an outward projecting protuberance. Preferably, stem 70 is reverse tapered, that is of smaller diameter at it proximal end, or, as shown, has a distal enlarged portion, such as bulb 75. Enhancer 60 is attached to band 20 from inner side 22 by insertion of stem 70 into bore 50 with a small amount of force such that bulb 75 passes through aperture 56 in O-ring 55. Bulb 75 is larger in diameter than aperture 56 such that aperture 56 is elastically deformed by being compressed by passage of bulb 75 and then expands to retain stem 70 in bore 50. A small force is required to detach enhancer 60 from band 20.

When enhancer 60 is attached to band 20, ornamental portions 80 are visible in front and in back of band 20. Ornamental portions 80 have band-facing sides 82. Front ornamental portion 80F has band-facing side 82F attached to front side 63 of base 60 and back ornamental portion 80B has band-facing side 82B attached to back side 64 of base 60. Preferably, band-facing side 82 of ornamental portions 80 upwardly conform to front side 30 and back side 35 of band 20 so as to fit snugly against band 20 so as to not rattle and so as to appear to be an integral part of ring 10. Ornamental portions 80 may include stones, such as gems 86. Preferably, the inner sides 84 of ornamental portions 80 are a continuation of the inner side 65 of base 60 and are concave to conform to a finger.

Base 62 is thin so as to not significantly change ring size. Attachment of enhancer 60 only changes size by one-quarter of a ring size. Base 62 is made of suitable strong material as is common in the jewelry art, such as gold alloy. Base 62 may be thin because the base 62 is curved and further because the band facing sides 82F, 82B of ornamental portions 80 act as webs or stiffening walls. Therefore, very thin 10 K or 14 K gold still provides excellent strength.

FIG. 8 is a top plan view of an alternate enhancer 60A. FIG. 9 is a front elevation view of the alternate enhancer 60A of FIG. 8. Alternate enhancer 60A is functionally equivalent of enhancer 60 and differs only in appearance. Alternate enhancer 60A is attached to band 20 in the same manner as enhancer 60.

In this manner a plurality of similarly dimensioned bands 20 with different settings 40 and a plurality of similarly dimensioned enhancements 60 of various design can be combined in a multiplicity of ring 10 combinations.

Having described the invention, it can be seen that it provides a very convenient and economical manner for altering the appearance of a jewel.

Although a particular embodiment of the invention has been illustrated and described, various changes may be made in the form, composition, construction, and arrangement of the parts without sacrificing any of its advantages. It can be seen that the broadest principle of the invention of attaching an enhancer as shown and described is applicable to other jewels, such as earrings or other pendants and broaches. Therefore, it is to be understood that all matter herein is to be interpreted as illustrative and not in any limiting sense, and it is intended to cover in the appended claims such modifications as come within the true spirit and scope of the invention.

I claim:

1. Jewelry comprising:

a jewel including:

an outer display side having a front edge; and a back edge;

an inner side opposite said display side including:

a bore therein including:

a catch therein;

a front edge; and a back edge;

a front side joining said front edge of said display side and said front edge of said inner side; and a back side joining said back edge of said display side and said back edge of said inner side; and an enhancer comprising:

a base including:

an outer mating side having a front; and a back;

an inner side, opposite said mating side, having:

a front edge; and a back edge;

a front side joining said front edge of said mating side and said front edge of said outer side; and a back side joining said back edge of said mating side and said back edge of said outer side;

a stem attached to said mating side of said base; and a front ornamental portion attached to said front side of said base and projecting outwardly therefrom; said enhancer being attached to said jewel by insertion of said stem into said bore from said inner side of said jewel and retention of said stem in said bore by said catch such that said front ornamental portion projects outward past said front edge of said inner side of said jewel toward said display side of said jewel.

2. The jewelry of claim 1 wherein:

said catch comprises a resilient collar that is elastically deformed upon insertion of said stem in said bore.

3. The jewelry of claim 1 wherein:

said stem has a bulbous portion; and said catch comprises a resilient collar having a central bore;

upon attachment of said enhancer to said jewel, said central bore being elastically deformed by said bulbous portion.

4. The jewelry of claim 1 wherein:

said enhancer further includes:

a back ornamental portion attached to said back side of said base and projecting outwardly therefrom; when said enhancer is attached to said jewel, said back ornamental portion projecting outward past said back edge of said inner side of said jewel toward said display side of said jewel.

5. The jewelry of claim 1 wherein:

said bore is a blind bore.

6. The jewel of claim 1 wherein:

said front ornamental portion of an attached said enhancer projects outward past said front edge of said display side of said jewel.

7. A finger ring comprising:

a band for encircling a finger; said band including:

an inner side, for encircling the finger and facing the finger, having:

a bore therein including:

a catch therein;

a front edge; and a back edge;

a display side opposite said inner side of said band and radially outwardly disposed therefrom; said display side having:

a front edge; and a back edge;

a front side joining said front edge of said inner side of said band and said front edge of said display side; and a back side, opposite said front side of said band, joining said back edge of said inner side of said band and said back edge of said display side; and an enhancer comprising:

a base including:

an inner side, facing the finger, having:

a front edge; and a back edge;

an outer side, opposite said inner side of said base, having:

a front edge; and a back edge;

a front side joining said front edge of said inner side of said base and said front edge of said outer side of said base; and a back side, opposite said front side of said base, joining said back edge of said inner side of said base and said back edge of said outer side of said base;

a stem attached to said outer side of said base; and a front ornamental portion attached to said front side of said base and projecting outward therefrom;

said enhancer being attached to said band from said inner side of said band by insertion of said stem into said bore and retention of said stem in said bore by said catch such that said front ornamental portion projects radially outward past said front edge of said inner side of said band toward said display side of said band.

8. The ring of claim 7 wherein:

said catch comprises a resilient collar that is elastically deformed upon insertion of said stem in said bore.

9. The ring of claim 7 wherein:

said stem has a bulbous portion; and said catch comprises a resilient collar having a central bore;

upon attachment of said enhancer to said band, said central bore being elastically deformed by said bulbous portion.

10. The ring of claim 7 wherein:

said enhancer further includes:

a back ornamental portion attached to said back side of said base and projecting outward therefrom; when said enhancer is attached to said band, said back ornamental portion projecting radially outward past said back edge of said inner side of said band toward said display side of said band.

11. The ring of claim 7 wherein:

said bore is not visible when said band is on a finger without said enhancer.

12. The ring of claim 7 wherein:

said bore is radially outward.

13. The ring of claim 7 wherein:

said front ornamental portion of an attached said enhancer projects radially outward past said front edge of said display side of said band.

14. A finger ring comprising:

a band for encircling a finger; said band including:

an inner side, for encircling the finger and facing the finger, having:

a front edge; and a back edge;

a display side opposite said inner side of said band and radially outwardly disposed therefrom; said display side having:

a front edge; and a back edge;

a front side joining said front edge of said inner side of said band and said front edge of said display side;

a back side, opposite said front side of said band, joining said back edge of said inner side of said band and said back edge of said display side; and a bore in said inner side of said band including:

a resilient collar therein; and an enhancer comprising:

a base including:

an inner side, for disposition toward the finger, having:

a front edge; and a back edge;

an outer side, opposite said inner side of said base, having:

a front edge; and a back edge;

a front side joining said front edge of said inner side of said base and said front edge of said outer side of said base; and a back side, opposite said front side of said base, joining said back edge of said inner side of said base and said back edge of said outer side of said base;

a stem attached to said outer side of said base; and a front ornamental portion attached to said front side of said base and projecting outwardly therefrom;

said enhancer being attached to said band from said inner side of said band by insertion of said stem into said bore whereby said stem elastically deforms said collar whereby said collar retains said stem in said bore such that said front ornamental portion projects radially outward past said front edge of said inner side of said band toward said display side of said band.

15. The ring of claim 14, wherein:

said stem has a bulbous portion; and said resilient collar includes a central bore; upon attachment of said enhancer to said band, said central bore being elastically deformed by said bulbous portion.

16. The ring of claim 14 wherein:

said enhancer further includes:

a back ornamental portion attached to said back side of said base and projecting outward therefrom; when said enhancer is attached to said band, said back ornamental portion projecting radially outward past said back edge of said inner side of said band toward said display side of said band.

17. The ring of claim 14 wherein:

said bore is not visible when said band is on a finger without said enhancer.

18. The ring of claim 14 wherein:

said front ornamental portion of an attached said enhancer projects radially outward past said front edge of said display side of said band.

19. In combination:

a finger ring comprising:

a band for encircling a finger; said band including:

an inner side for encircling the finger and facing the finger; said inner side having:

a bore therein including:

a catch;

a front edge; and a back edge;

a display side opposite said inner side of said band and radially outwardly disposed therefrom; said display side having:

a front edge; and a back edge;

a front side joining said front edge of said inner side of said band and said front edge of said display side;

a back side, opposite said front side of said band, joining said back edge of said inner side of said band and said back edge of said display side; and a plurality of enhancers; each said enhancer comprising:

a base including:

an inner side, for disposition toward the finger, having:

a front edge; and a back edge;

an outer side, opposite said inner side of said base, having:

a front edge; and a back edge;

a front side joining said front edge of said inner side of said base and said front edge of said outer side of said base; and a back side, opposite said front side of said base, joining said back edge of said inner side of said base and said back edge of said outer side of said base;

a stem attached to said outer side of said base; and a front ornamental portion attached to said front side of said base and protecting outward therefrom;

each said enhancer being attachable to said band from said inner side of said band by insertion of its said stem into said bore and retention of its said stem in said bore by said catch such that said front ornamental portion of an attached said enhancer projects radially outward past said front edge of said inner side of said band toward said display side of said band.

20. The combination of claim 19 wherein:

said catch comprises a resilient collar that is elastically deformed upon insertion of a said stem in said bore.

21. The combination of claim 19 wherein:

each said stem has a bulbous portion; and said catch comprises a resilient collar having a central bore;

upon attachment of a said enhancer to said band, said central bore being elastically deformed by said bulbous portion.

22. The combination of claim 19 wherein:

each said enhancer further includes:

a back ornamental portion attached to said back side of said base and projecting outward therefrom; when a said enhancer is attached to said band, its said back ornamental portion projects radially outward past said back edge of said inner side of said band toward said display side of said band.

23. The combination of claim 19 wherein:

said bore is not visible when said ring is on a finger without an attached said enhancer.

24. The combination of claim 19 wherein:

said front ornamental portion of an attached said enhancer projects radially outward past said front edge of said display side of said band.

* * * * *